United States Patent [19]

Ellen

[11] Patent Number: 5,069,008

[45] Date of Patent: Dec. 3, 1991

[54] BUILDING PANEL

[75] Inventor: Peter E. Ellen, Sydney, Australia

[73] Assignee: Elspan International Ltd., Hong Kong

[21] Appl. No.: 379,628

[22] Filed: Jul. 14, 1989

[51] Int. Cl.[5] ..... E04B 1/32; E04B 7/10; E04B 7/14

[52] U.S. Cl. ..... 52/80; 52/83; 52/86; 52/309.11

[58] Field of Search ..... 52/80, 81, 200, 86, 52/83, 309.11

[56] References Cited

U.S. PATENT DOCUMENTS

| | | | |
|---|---|---|---|
| 2,912,940 | 11/1959 | Baroni | 52/80 |
| 2,918,023 | 12/1959 | Bettcher | 52/200 |
| 3,143,194 | 8/1964 | Hart | 52/80 |
| 3,200,026 | 8/1965 | Brown | 52/80 |
| 3,204,372 | 9/1965 | Richter | 52/80 |
| 3,349,525 | 10/1967 | Payne | 52/80 |
| 3,389,513 | 6/1968 | Ruggles | 52/630 |
| 3,439,459 | 4/1969 | Silberkuhl | 52/86 |
| 3,568,381 | 3/1971 | Hale | 52/81 |
| 3,591,991 | 7/1971 | Zetlin | 52/80 |
| 3,774,358 | 11/1973 | Hale | 52/81 |
| 3,918,226 | 11/1975 | Naidus | 52/200 |

*Primary Examiner*—John E. Murtagh

*Attorney, Agent, or Firm*—Fleit, Jacobson, Cohn, Price, Holman & Stern

[57] ABSTRACT

A building panel for use in walls of roofs the panel being formed from a sheet of material the sheet being rectangular and made up of four portions the surfaces of each of which are in the form of a hyperbolic paraboloid, the edges of the portions meeting on transverse axes of the panel, corners of said portions meeting at a central point displaced from a plane containing the periphery of the panel. The panel being capable of acting as both the covering and a structural member spanning between frames of a structure thus avoiding the necessity for using pylons, the invention also consists in the use of such panels in a building structure.

4 Claims, 7 Drawing Sheets

BUILDING PANEL

BACKGROUND OF THE INVENTION

The present invention relates to panels for the construction of roofs and walls in buildings particularly buildings such as sheds, hangars and warehouses.

In the construction of roofs and walls of a building such as an aircraft hangar or a large warehouse it is usual to use steel purlins spanning between frames of the structure, the purlins being covered with a metal cladding such as corrugated iron. The assembly of structures constructed on these lines requires a considerable number of man hours to assemble and screw fix all the sheeting members to the purlins.

An alternative method at present in use is to use prefabricated metal "sandwich" planar panels. Such panels are used to span between frame members of the structure but have a very limited stiffness.

SUMMARY OF THE INVENTION

The present invention is based on the provision of a form of panel which owing to its physical characteristics can act both as a covering and structural member spanning between frames of a structure, thus avoiding the necessity for using purlins.

The present invention consists in a building panel for use in walls or roofs the panel being formed from a sheet of material the sheet being rectangular and made up of four portions the surfaces of each of which are in the form of a hyperbolic paraboloid, the edges of the portions meeting on sloping lines lying on transverse axes of the panel, corners of said portions meeting at a central point displaced from a plane containing the periphery of the panel.

It is preferred that the panel be elongate in form having a length substantially greater than its width and wherein edges of the portions that meet on the longer axis of the sheet meet in a line that lies at an angle $\theta_1$, to a line in the plane of the periphery of the sheet for which tan $\theta_1$, ranges from 0.05 to 0.20 and wherein edges of the portions that meet on the shorter axis of the sheet meeting in a line making an angle $\theta_2$ to a line in the plane of the periphery of the sheet wherein tan $\theta_2$ ranges from 0.2 to 1.0.

The invention further consists in a building structure made of a plurality of frames arranged parallel to each other, the structure being covered by panels as defined in either of the last preceding paragraphs, the panels extending between and being secured to the frames.

BRIEF DESCRIPTION OF DRAWINGS

In order that the invention may be better understood and put into practice preferred forms thereof are hereinafter described by way of example with reference to the accompanying drawings in which.

DESCRIPTION OF PREFERRED EMBODIMENTS

Figure 1:
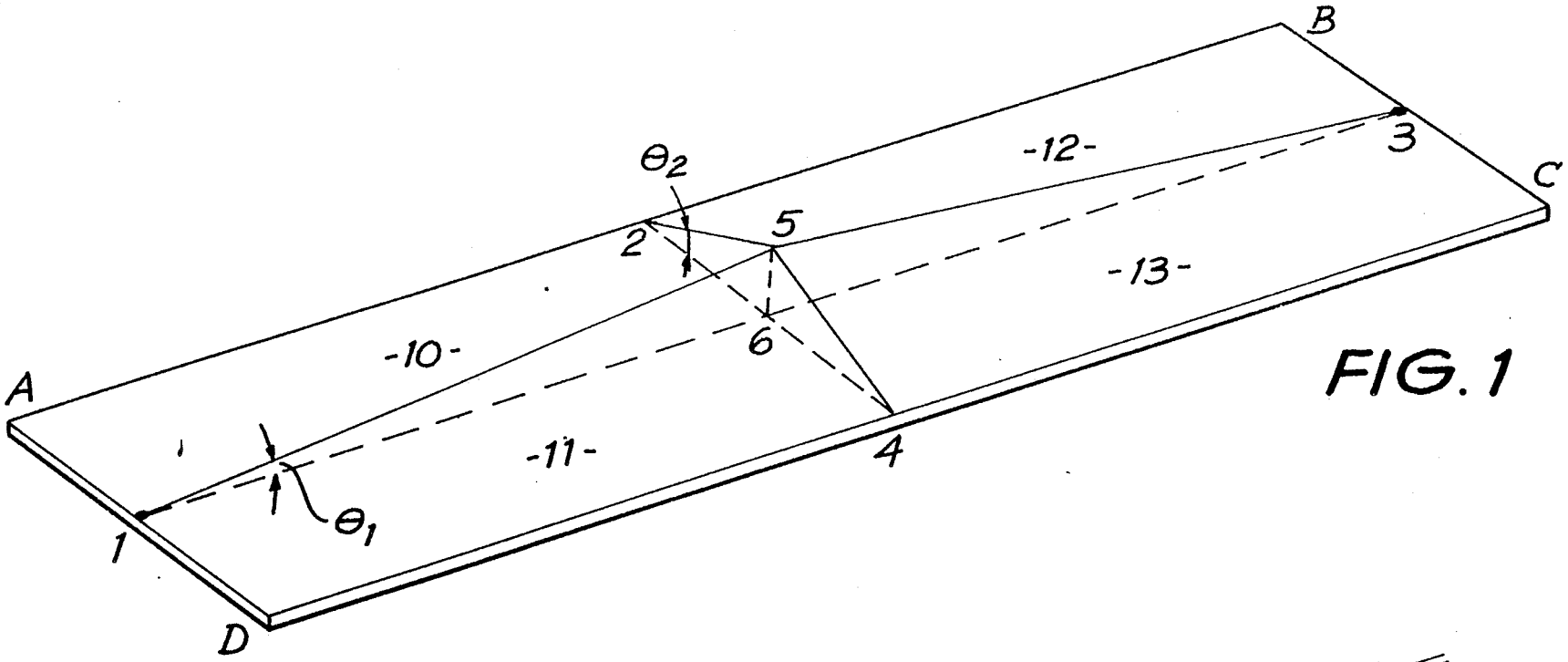
FIG. 1 illustrates the shape of a typical panel according to the invention.

FIG. 1 shows a typical panel according to the invention. Such a panel may have, for example, a length of 10 meters and a width of 2.3 meters and consists of a single sheet of material for example aluminum or fiberglass. In the case of aluminum the sheet is formed by, deforming a flat sheet in a mold. In the case of fiberglass the sheet is formed by the use of a suitably shaped mold by conventional methods.

The essential feature of the panel is that it is made of four portions 10, 11, 12 and 13. Portion 10 for example extends between the points A, 2, 5 and 1. The surfaces of each portion are in the form of a hyperbolic paraboloid. Portions 10, 11, 12 and 13 meet on lines overlying the axes of the panel, portions 10 and 11 for example meeting on the line joining points 1 and 5. All four portions meet at the central point 5 which is spaced apart from the point 6 which lies in the plane of the periphery of the sheet. With the dimensions given above the distance between the points 5 and 6 may be, for example, 500 millimeters.

The hyperbolic paraboloid surfaces of the portions of the panel give the panel great rigidity and make it suitable for connection directly to the frames of a structure without the use of intervening purlins. To obtain the best advantage from the invention it is desirable that the angle made by the lines along which the portions join and the corresponding axis of the sheet should be within certain limits. In FIG. 1 the angle between the line 1–5 and the line 1–6 is designated as $\theta_1$, and it is preferred that tan $\theta_1$, shall be in the range from 0.05 to 0.20. The angle between the lines 2–5 and 2–6 is designated as $\theta_2$ and it is preferred that tan $\theta_2$ be in the range 0.2 to 1.0.

Figure 2:
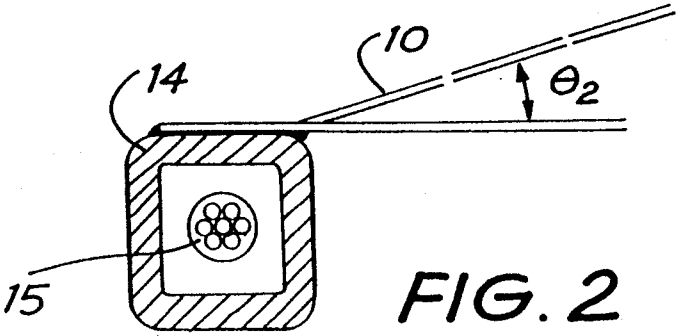
FIG. 2 is a cross-sectional view through an edge of a panel and an accompanying supporting member.

In mounting panels according to the invention in the structure it is preferred to provide along each edge, an edge stiffening member such as the member 14 shown in FIG. 2 through which a high tensile cable 15 passes.

Figure 3:
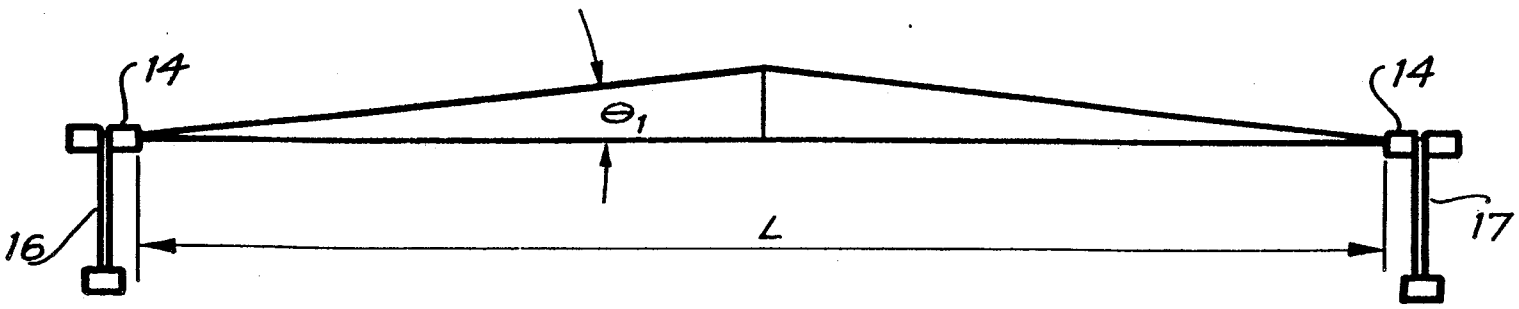
FIG. 3 illustrates the use of a panel according to the invention as a single structural member.

FIG. 3 illustrates the manner in which a panel according to the invention may be incorporated in a structure by being connected between frame members 16 and 17 of the structure.

Figure 4:
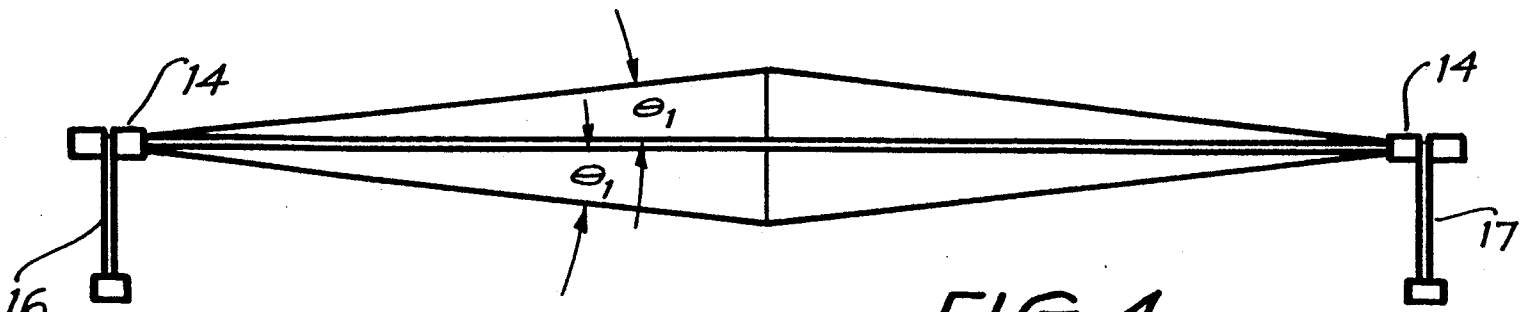
FIG. 4 illustrates a pair of panels combined to provide a double shell.

FIG. 4 and 4*a* illustrates how two panels according to the invention may be arranged concave face to concave face to produce a double shell there being a sealed airspace between the shells.

Figure 5:
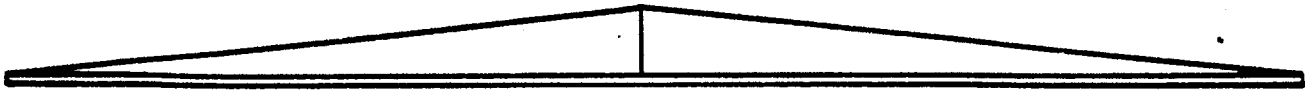
FIG. 5, 5*a* and cross-5*b* illustrate in elevation and section two panels placed over one another separated by an insulating material to form a sandwich panel.
Figure 5A:
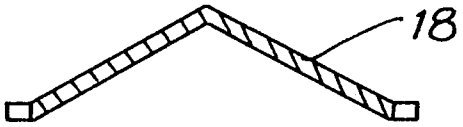
Figure 5B:
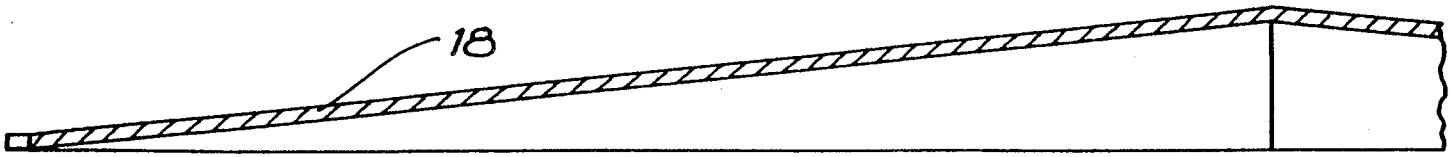

FIGS. 5, 5*a* and 5*b* illustrate the manner in which two panels according to the invention may be placed convex face to concave face with a layer of foam insulation 18 between them.

Figure 6:
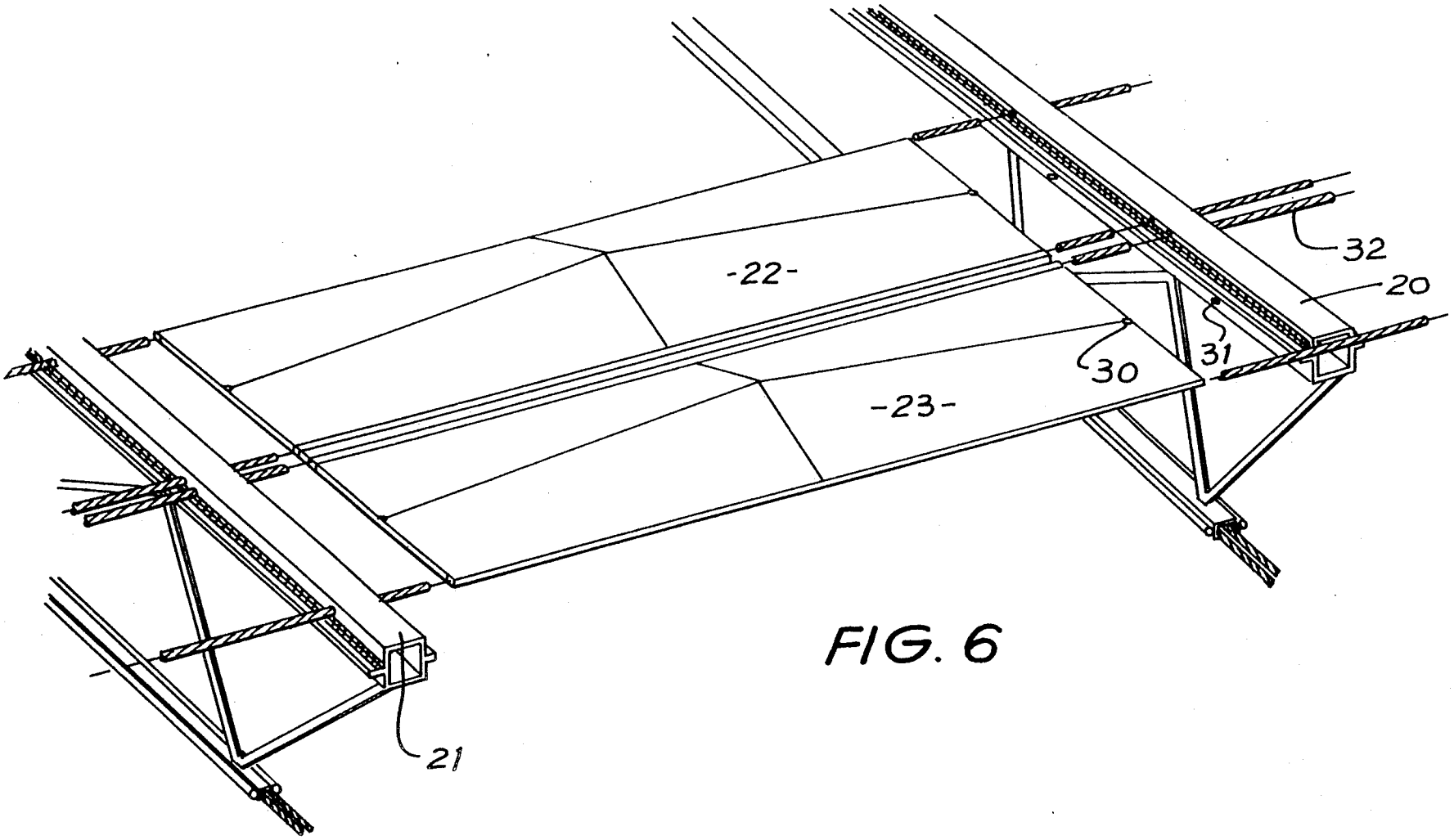
FIG. 6 illustrates a part of the roof of a structure showing two panels arranged between two structural frames.

FIG. 6 shows part of a roof construction in which the parts are separated for greater clarity. The structure consists of frame members 20 and 21 each in the form of a beam with a lower chord, post-tensioned by means of cables in a conventional manner.

Figure 7:
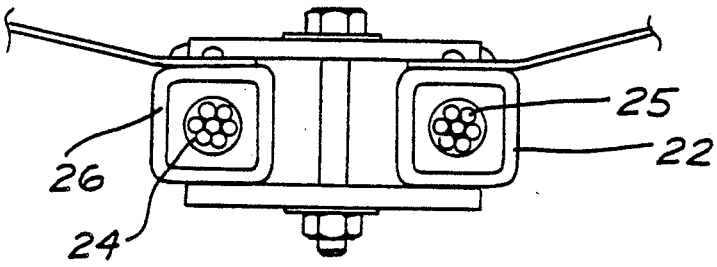
FIG. 7 is a cross-sectional view illustrating a joint between two panels.

Two panels according to the invention 22 and 23 are shown. These are joined edge to edge in the manner illustrated in FIG. 7 with high tension steel cables 24 and 25 passing through each member 26 and 27, the cables being plastic coated or grout encased.

Figure 8:
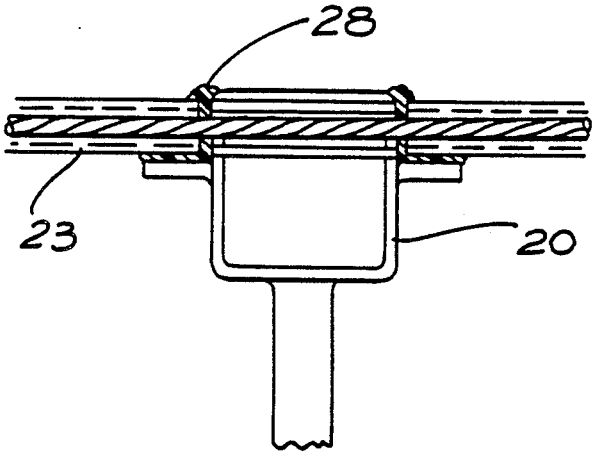
FIG. 8 is a sectional view illustrating a joint between panels and a structural frame member.

FIG. 8 shows the manner in which the ends of the panels 22 and 23 are connected to the frame member 20, a layer of sealant material 28 ensuring watertightness of the joint. Locating pins such as 30 are provided to locate the panels in relation to holes in the frame member 20 such as 31 to hold the panels in position during assembly of the structure. After assembly, transverse cables such as 32, passing along the long edges of the panels are tensioned and secured.

Figure 9:
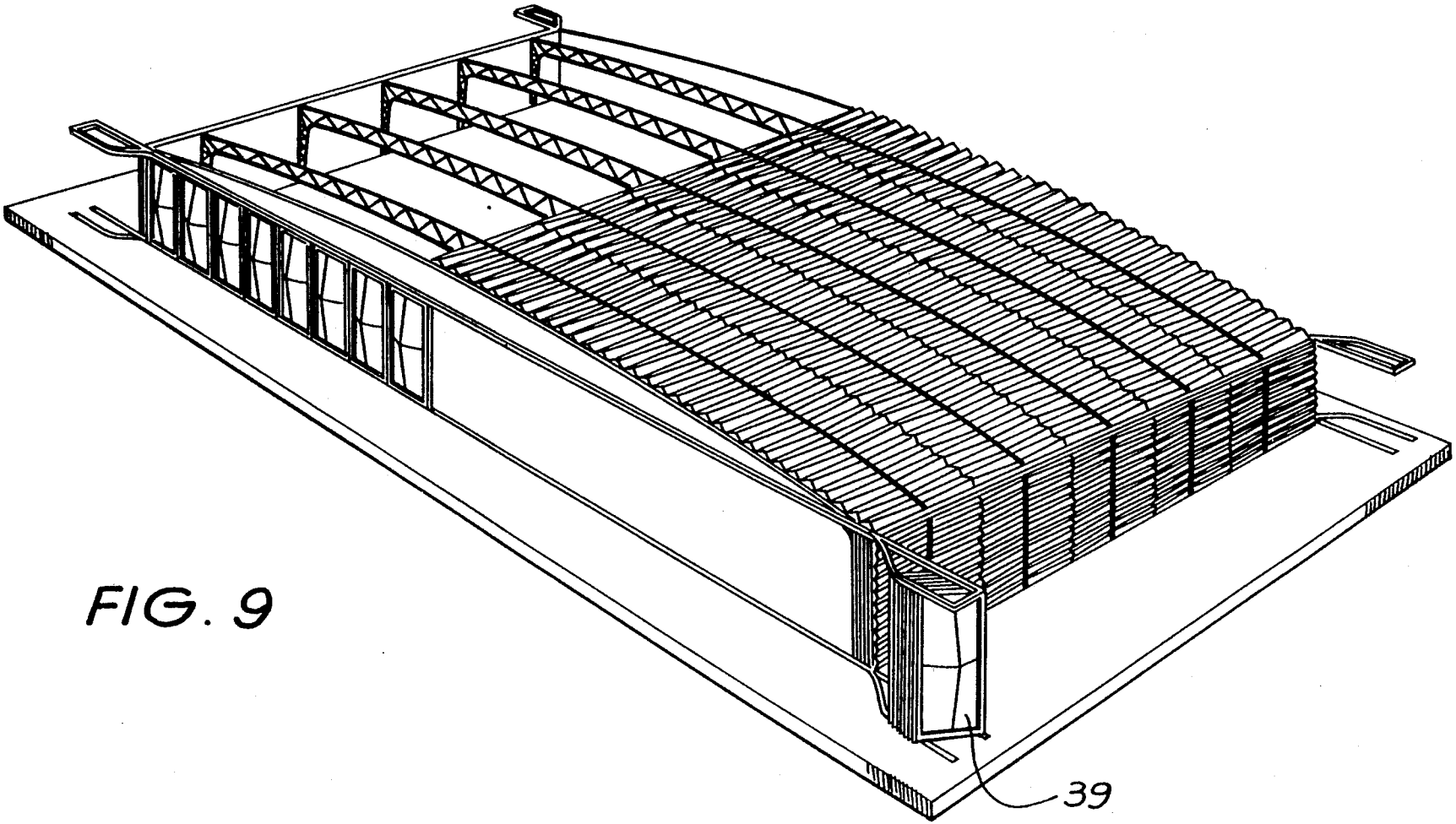
FIG. 9 is a perspective view of an aircraft hangar constructed of frames covered with panels according to the invention.

FIG. 9 shows a complete structure in the form of an aircraft hangar consisting of frame members interconnected by means of panels according to the invention both in the roof and in the walls. The dimensions of the particular hangar structure shown are such as to provide a span of 144×35 meters individual frame members being spaced 17 meters apart, the maximum height of the structure being 33 meters and the free height of the entrance to the hangar being 23 meters. In addition the doors such as 33 consist of panels according to the invention.

Figure 10:
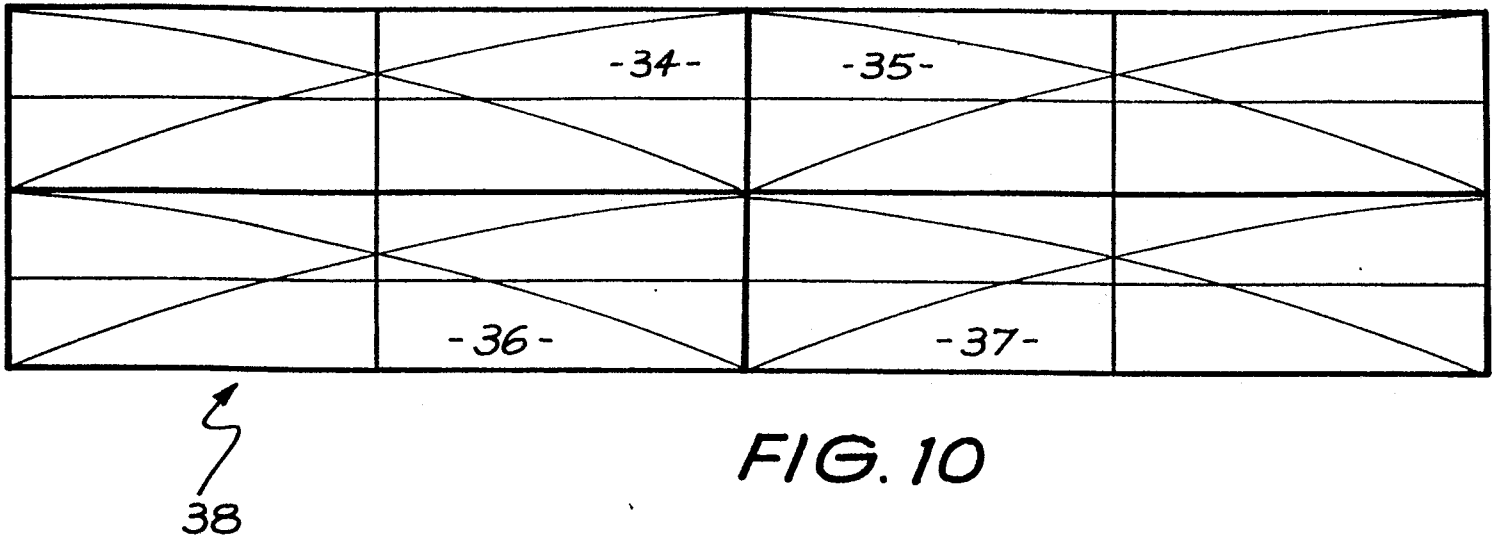
FIGS. 10 and 10*a* show in plan and elevation a hyperbolic paraboloid shaped frame to which four panels are attached.
Figure 10A:
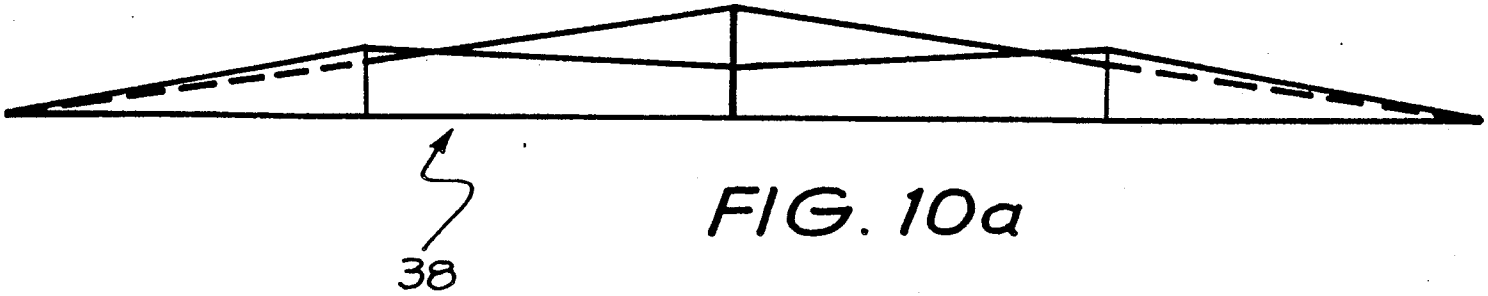

For larger doors four panels may be attached to a hyperbolic paraboloid shaped frame as shown in FIG. 10 and 10*a*. Such frames can be used for all forms of exterior walling roofing and doors to large buildings. In FIGS. 10 and 10*a* four panels 34, 35, 36 and 37 are attached to a frame 38 which is itself constructed so that the panels occupy hyperbolic paraboloid surfaces of the frame.

The essential feature of the invention is the particular shape of the panel which may be realized in panels of a wide variety of shapes and sizes. The panels described above are given by way of example as are the various methods of fixing and the type of structure that may be produced by use of the panels.

The claims defining the invention as follows:

1. A building panel for use in walls or roofs, the panel comprising: transverse intersecting axes and a periphery lying in a common plane and being formed by a flat rectangular sheet of metal deformed in a mold and comprising four portions; each portion having a surface in the form of a hyperbolic paraboloid, edges and corners; two edges of each portion meeting edges on adjacent portions in transverse intersecting planes including said transverse axes of the panel, and one corner of each portion meeting at a central point of the panel at the intersection of said transverse planes displaced from a plane containing the periphery of the panel; said panel further being elongate in form and having a length substantially greater than its width; and wherein edges of said portions that meet on the plane containing the longer axis of the panel meet in a line that lies at an angle $\theta_1$ to a line in said plane containing the periphery of the panel for which tan $\theta_1$ ranges from 0.05 to 0.20, and edges of portions that meet on the plane containing the shorter axis of the panel meet in a line making an angle $\theta_2$ to a line in said plane containing the periphery of the panel, $\theta_2$ being in the range from 0.2 to 1.0; a tubular edge stiffening member along each longitudinal peripheral edge of the panel; cable means extending longitudinally through the edge stiffening members; and means for tensioning said cable means and applying the force of the tensioned cable means to said edge stiffening members in use to compress the edges of the panel to prevent buckling.

2. A building panel as claimed in claim 1 consisting of two such panels arranged concave face to concave face to include a sealed airspace.

3. A building panel consisting of two panels as claim 1 in arranged convex face to concave face with a layer of foam insulation between.

4. A building structure comprising a plurality of upstanding frame members arranged in a parallel relationship, the frame members being interconnected by panels as claimed in claim 1 the panels constituting the cladding of the structure.

* * * * *